US006521092B2

(12) United States Patent
Isometsä

(10) Patent No.: US 6,521,092 B2
(45) Date of Patent: Feb. 18, 2003

(54) BEAM THAT CAN BE BENT FOR USE IN A PAPER OR BOARD MACHINE

(75) Inventor: Juha Isometsä, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/867,105

(22) Filed: May 29, 2001

(65) Prior Publication Data

US 2002/0060033 A1 May 23, 2002

Related U.S. Application Data

(63) Continuation of application No. PCT/FI99/00986, filed on Nov. 30, 1998.

(30) Foreign Application Priority Data

Nov. 30, 1998 (FI) ..... 982585

(51) Int. Cl.[7] ..... D21G 9/00; D21G 3/00
(52) U.S. Cl. ..... 162/272; 162/281
(58) Field of Search ..... 162/111, 198, 162/199, 272, 281; 152/256.51, 256.53; 101/120, 157, 169, 350.6; 118/100, 107, 110, 119, 126, 261, 413; 210/376; 399/284, 350, 351; 427/356; D25/122, 126

(56) References Cited

U.S. PATENT DOCUMENTS

| | | | | |
|---|---|---|---|---|
| 3,438,100 A | | 4/1969 | Moore | |
| 3,604,087 A | * | 9/1971 | Beck | 492/6 |
| 3,611,471 A | | 10/1971 | Meskanen et al. | |
| 4,364,158 A | * | 12/1982 | Bainton | 492/7 |
| 4,470,183 A | | 9/1984 | Kuosa | |
| 5,061,533 A | | 10/1991 | Gomi et al. | |
| 5,356,519 A | * | 10/1994 | Grabscheid et al. | 162/281 |
| 5,993,548 A | | 11/1999 | Madrzak et al. | |

FOREIGN PATENT DOCUMENTS

| | | |
|---|---|---|
| FI | 965285 | 12/1996 |
| FI | 980464 U | 10/1998 |
| FI | 982294 | 10/1998 |
| WO | PCT/FI98/00623 | 2/1999 |

OTHER PUBLICATIONS

International Search Report issued in Patent Application No. PCT/FI99/00986, Mar. 22, 2000.
Official Action dated Nov. 15, 1999 with translation issued in Finnish Priority Application No. 982585.
Official Action of Approval dated Feb. 2, 2000 with translation issued in Finnish Priority Application No. 982585.
National Board of Patents and Registration Communication dated Mar. 28, 2000 with translation issued in Finnish Priority Application No 982585.
U.S. Application No. 09/425,708—Doctor Beam Fitted in Connection with a Roll or a Cylinder in a Paper Machine or a Board Machine—Oct. 22, 1999.

* cited by examiner

*Primary Examiner*—Steven P. Griffin
*Assistant Examiner*—Eric Hug
(74) *Attorney, Agent, or Firm*—Lathrop & Clark LLP

(57) ABSTRACT

A beam with a continuous body (11) of a composite material has end pieces (13) fitted at each end of the body (11) and axle journals (12) fitted on the end pieces (13). Each axle journal (12) is supported on the frame constructions of the machine by means of a support construction (15, 20, 21, 30, 31, 100), in which there are bearing members (21, 31) fitted at a distance from one another in the longitudinal direction of the axle journal (12). The bearing members (21, 31) are fitted in bearing housings (20, 30), and a bending mechanism (40, 50, 60) is fitted in the support construction (15, 20, 30, 100), by which a torque is applied that bends the body (11) of the beam. The beam may support doctor blades, various measurement devices, induction devices, and coating devices.

28 Claims, 8 Drawing Sheets

BEAM THAT CAN BE BENT FOR USE IN A PAPER OR BOARD MACHINE

CROSS REFERENCES TO RELATED APPLICATIONS

This application is a continuation of PCT Application No. PCT/FI99/00986, and claims priority on Finnish Application No. 982585, filed Nov. 30, 1998, the disclosures of both of which applications are hereby incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention concerns a beam that can be bent for use in a paper or board machine.

In paper or board machines, beams are used, for example, for support of doctor blades, for support of various measurement devices, for support of induction devices, and for support of coating devices. The criteria of dimensioning of beams that support a doctor blade are, as a rule, natural frequency and bending. In the case of steel beams, the principal criterion is, as a rule, natural frequency, in which case the bending rates are, as a rule, rather little. If a support beam is made of a composite material, the decisive criterion will be the bending arising from the load applied by the blade to the beam. One mode of compensating for the bending is to bend the support beam.

In the applicant's U.S. Pat. No. 3,611,471, one possibility is suggested for bending a doctor device. The frame of the doctor device consists of a box-like frame beam, to which the doctor blade has been attached. In the interior of the box beam, there is a box-like inner beam, whose ends have been attached to the end pieces of the frame beam. To said end pieces, axle journals have also been attached, which axle journals are additionally mounted on support constructions. The mounting of the axle journals permits turning of the doctor device around the longitudinal axis. The axle journals have been coupled with the turning cylinders at the ends of the doctor device, and by means of said turning cylinders the doctor blade can be pressed with the desired force against the face of the roll. Between the vertical walls of the box-like frame of the doctor device and the vertical walls of the box-like inner beam, there are box-like channels extending across the longitudinal direction of the doctor device. In these channels, loading hoses have been fitted, into which hoses a pressure medium can be passed so as to produce the desired loading pressure in said hoses. When pressure medium is passed into one of the loading hoses, it is possible to bend the frame beam to the desired arc form. In this way it is possible to compensate for bending of the middle part of the frame beam. Without this compensation, the doctor blade is pressed against the roll face with a lower force in the middle part of the roll as compared with the edges of the roll. In this prior-art solution, the frame of the doctor device is made of steel.

In the FI Patent Application 965285, a support beam for a coating device is described. The support beam is supported by means of two support points, which are placed, in the longitudinal direction of the beam, on the portion between the centre of the beam and the end of the beam at a distance from the ends of the beam. When the support points are shifted from outside the ends of the beam to between the beam ends and the beam centre, the bending of the beam can be reduced, and the natural frequency of the beam can be raised. Thus, what is concerned here is not active regulation of the bending of the beam, but attempts are made to reduce the bending of the beam by shortening the distance between the support points. Also in this prior-art solution, the support beam is made of steel.

In the applicant's FI Patent Application 982294, a beam construction of composite material for a paper or board machine is described. The beam is made of a first curved part and of a connected straight part. Doctoring, coating or measurement devices have been mounted on the straight part.

In the applicant's FI Utility Model Application 980464, a second doctor beam is described, which is made of a composite material and which is placed in connection with a roll or a cylinder in a paper or board machine. The doctor beam comprises at least one such face portion whose shape is curved and complies with the curve form of the adjacent roll mantle.

In the U.S. Pat. No. 5,356,519, a third doctor-blade support beam made of a composite material is described. The beam is provided with an oblong hollow body, which comprises at least two longitudinal convex walls. The length of the radius of the arc defined by the convexity of the walls is longer than the width of the wall, and the walls are interconnected by transition pieces, whose curve radius is shorter than the width of the adjacent oblong wall.

SUMMARY OF THE INVENTION

In the beam in accordance with the invention, there is a body made of a composite material. To both ends of the body, end pieces have been fitted, to which end pieces axle journals have again been fitted. The axle journals are supported on the frame constructions of the machine by means of a support construction, which support construction also includes a bending mechanism, by whose means a torque that bends the body of the beam can be applied to the axle journals. When a torque acting in the same direction is applied to the axle journals placed at the ends of the beam, the body of the beam can be bent to the desired arc form. The construction of the beam in accordance with the invention is simple, and its need of servicing is little. The simple construction makes the manufacture of the beam easy and of favourable cost. Also, simple construction facilitates the maintenance of the beam.

A beam of a composite material is of considerably lower weight, as compared with a steel beam, and by means of the bending mechanism mentioned above a bending of the beam can be readily compensated for. By means of the bending mechanism, the beam can be bent to the desired curve form depending on the need in each particular case.

A beam in accordance with the invention can be used, for example, for support of doctor blades, for support of various measurement devices, for support of induction devices, and for support of coating devices.

In the following, the invention will be described with reference to the figures in the accompanying drawings, the invention being, however, not supposed to be confined to the details of said illustrations alone.

DESCRIPTION OF THE PREFERRED EMBODIMENTS

Figure 1:
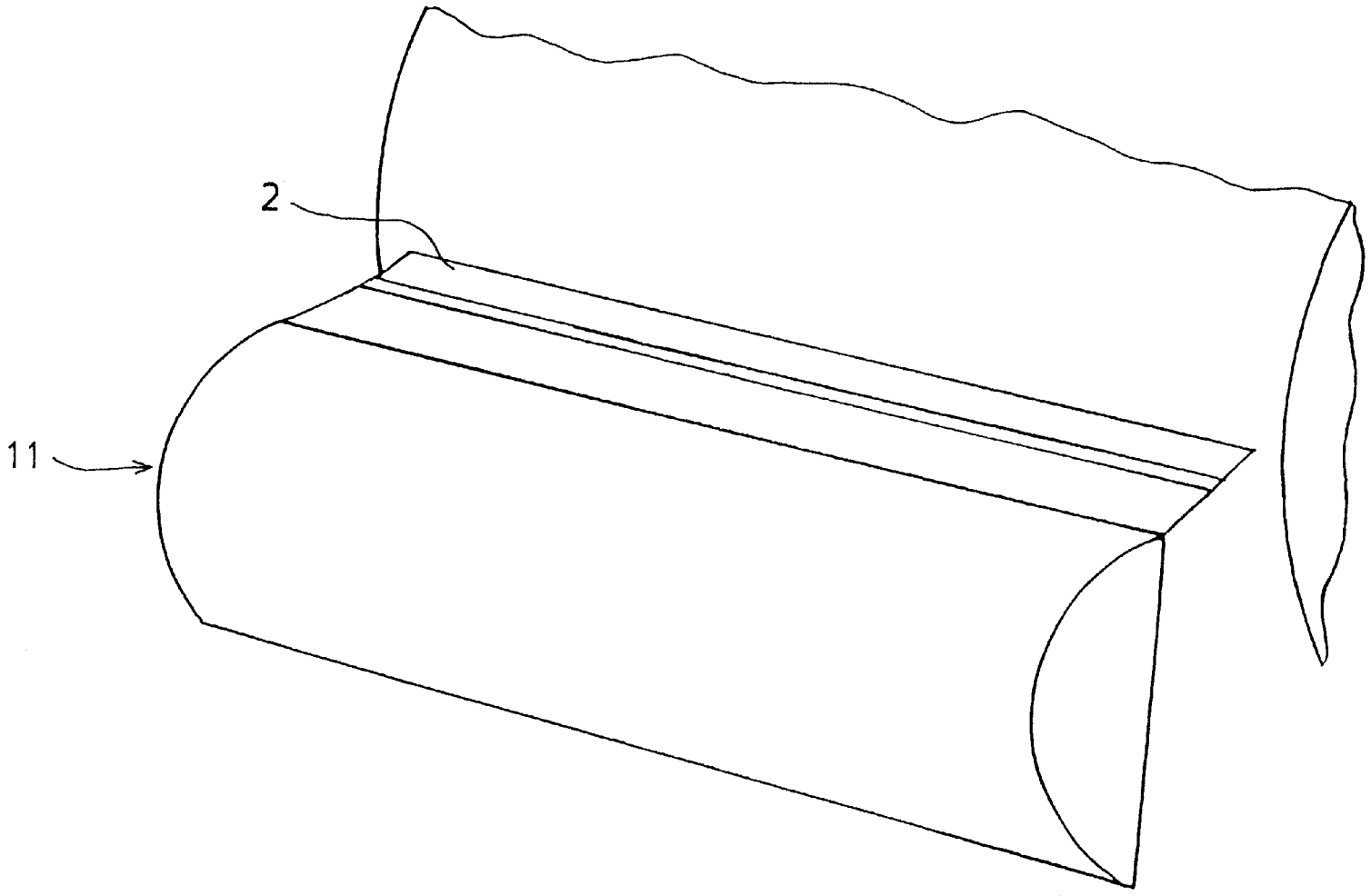
FIG. 1 is a schematic axonometric view of a support beam for a doctor blade.

FIG. 1 is a schematic axonometric view of a doctor beam. To the beam 11, a doctor blade 2 has been attached, by whose means the roll 1 is cleaned. The cross-section of the beam 11 is formed by a curved part and by a connected straight part. The interior of the beam is hollow. The beam in accordance with the present invention is, however, in no way confined to such a cross-sectional form, but the cross-section of a beam in accordance with the invention can be, for example, similar to that described in the applicant's said FI Patent Application 982294 or similar to that described in the applicant's said FI Utility Model Application 980464. The cross-section of the beam in accordance with the invention can also be, for example, shaped as a circle, a square provided with rounded corners, or a triangle provided with rounded corners. In the case of the cross-section of a beam shaped as a triangle provided with rounded corners, in stead of being a straight line, one or several sides of the triangle may be formed by a broken line.

Figure 2:
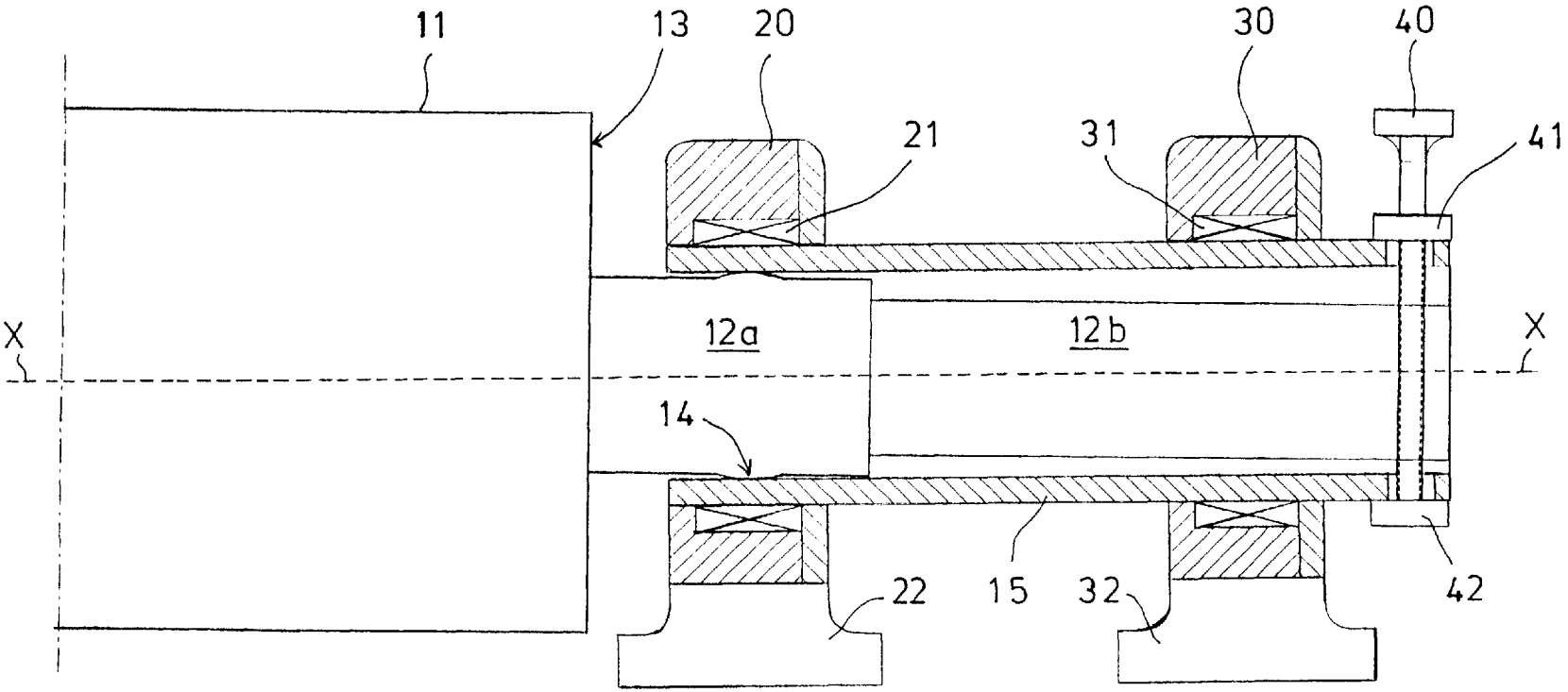
FIG. 2 is a schematic illustration of an end area of an embodiment of the beam in accordance with the invention.

FIG. 2 shows an embodiment of a beam in accordance with the invention. The figure shows one of the end areas of the beam. The beam consists of a unified body 11 made of a composite material, and end pieces 13 have been fitted to the ends of the body. On the other hand, axle journals 12 have been fitted to the end pieces 13. In the figure, the longitudinal central axis X—X of the axle journals 12 is shown in a situation in which no torque that bends the body 11 of the beam is applied to the axle journals 12.

In FIG. 2, the axle journals 12 consist of two parts 12*a*,12*b*. To the end piece 13 of the body 11 of the beam, an inner part 12*a* and a following outer part 12*b* have been fitted. The diameter of the inner part 12*a* is larger than the diameter of the outer part 12*b*. The axle journals 12 can, of course, physically, consist of one piece, in which case said parts 12*a*,12*b* have been formed, e.g., by turning on a lathe. In the middle area of the inner part 12*a* of the axle journal 12, there is a projection 14 which extends around the circumference of said inner part 12*a* and which constitutes an articulation member. The axle journal 12 is supported on the frame constructions of the machine by means of a support construction, which consists of a support sleeve 15, of bearing members 21, 31 and of bearing housings 20,30. On the outer part 12*b* and partly on the inner part 12*a* of the axle journal 12, a support sleeve 15 has been fitted, which is supported on the frame constructions of the machine by means of bearing members 21, 31 and by means of bearing housings 20,30 surrounding them, placed at a distance from one another in the longitudinal direction of the axle journal 12. The support sleeve 15 extends over the projection 14 provided on the inner part 12*b* of the axle journal 12, and the inner diameter of the support sleeve 15 is substantially equal to the outer diameter of the projection 14. The first bearing member 21 is placed at the projection 14 on the inner part 12*a* of the axle journal 12, and the second bearing member 31 is placed at a distance from the outer end of the outer part 12*b* of the axle journal 12 and of the support sleeve 15.

In FIG. 2, the body 11 of the beam is bent into curved form by means of a bending mechanism 40 acting upon the outer end of the outer part 12*b* of the axle journal 12. In this embodiment, the bending mechanism 40 consists of a screw member 40 extending through the end of the support sleeve 15 and through the outer end of the outer part 12*b* of the axle journal 12. The screw member 40 is provided with an outer threading extending substantially through the support sleeve 15, and the bore that extends through the outer part 12*b* of the axle journal 12 and that receives the screw member 40 is provided with a corresponding inner threading. Further, movement of the screw member 40 in the direction of its own longitudinal axis is prevented by means of fastening members 41, 42 resting against the outer face of the support sleeve 15 and attached to the screw member 40, e.g., by means of cotter pins. By rotating the screw member 40, it is possible to shift the outer end 12*b* of the axle journal from said longitudinal central axis X—X of the axle journal. In such a case, the articulation member 14 permits axial displacement of the axle journal 12 in relation to the support sleeve 15. When the axle journals 12 placed at both ends of the body 11 of the beam are bent in the same direction, the body 11 of the beam can be bent to the desired curved form.

The bearing members 21, 31 permit a slight movement of the support sleeve 15 in the longitudinal direction of the axle journal 12 in relation to the bearing housings 20,30, whose bottom parts 22,32 have been attached fixedly to the frame constructions of the machine. In this way, longitudinal oscillation of the beam is permitted, which oscillation is necessary, for example, when the beam operates as a support beam for a doctor that oscillates in the longitudinal direction.

In the following, the embodiments shown in FIGS. 3 to 8 will be described in the respects only in which they differ from the embodiment shown in FIG. 2. In FIGS. 3 to 8, for corresponding parts the same reference numerals are used as in FIG. 2.

Figure 3:
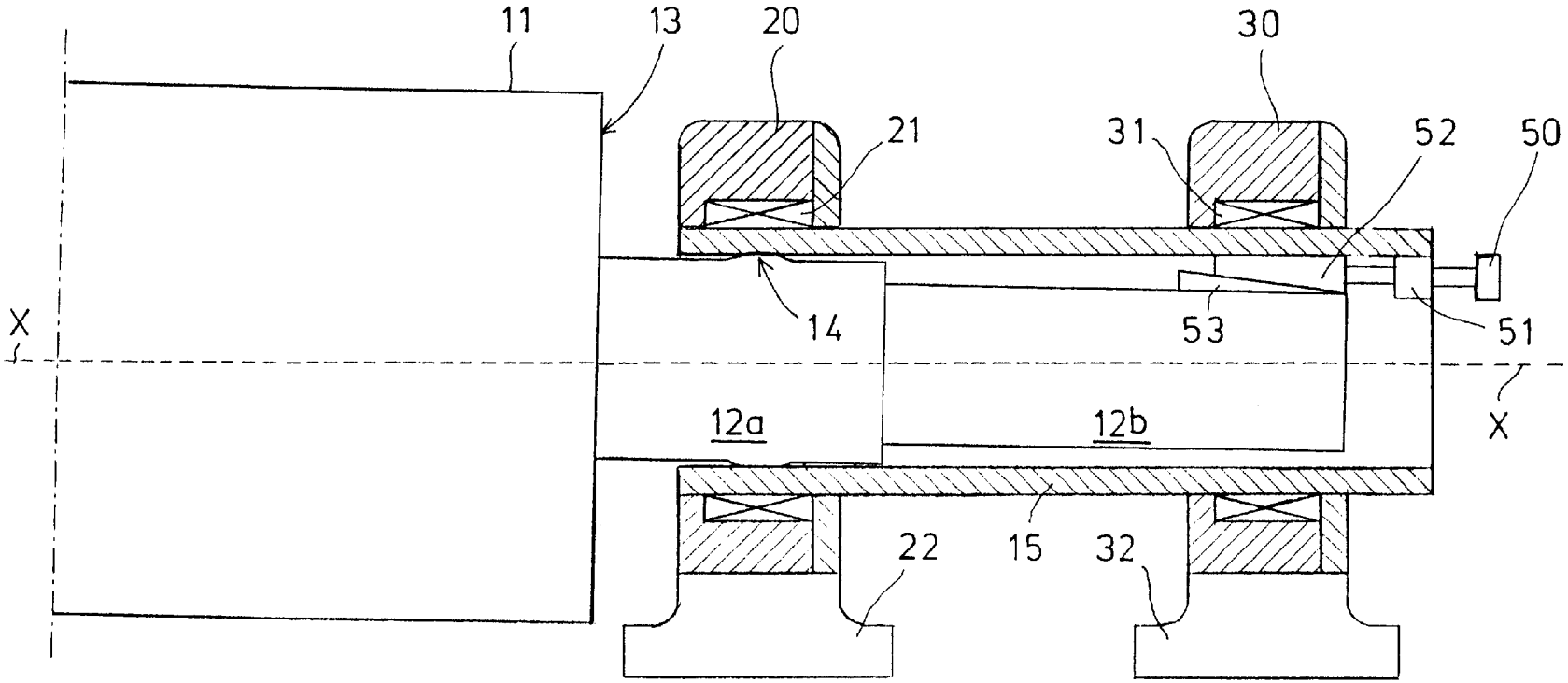
FIG. 3 shows a modification of the embodiment as shown in FIG. 2.

FIG. 3 shows an embodiment which differs from the embodiment of FIG. 2 in respect of the beam bending mechanism. In this embodiment, the beam bending mechanism consists of a screw member 50 provided with outside threading and placed at the outer end of the support sleeve 15 in the longitudinal direction of the axle journal 12. The screw member 50 has been fitted in a fastening member 51, which has been attached to the inner face of the support sleeve 15 at the outer end and which is provided with a bore placed in the longitudinal direction of the axle journal 12, which bore receives the screw member 50 and is provided with inside threading. The inner end of the screw member 50 is positioned against the end face of a first wedge member 52. The first wedge member 52 moves substantially in the longitudinal direction of the axle journal 12 on the inner face of the second support sleeve 15 by the effect of the screw member 50, but it has been locked on the inner face of the support sleeve 15 against radial movement. The wedge face of this first wedge member 52 is again positioned against the wedge face of a second wedge member 53 attached to the outer part 12*b* of the axle journal 12. When the first wedge member 52 is displaced by means of the screw member 50 to the left in the figure onto the second wedge member 53, the outer end 12*b* of the axle journal 12 is displaced from said longitudinal central axis X—X of the axle journal 12.

Figure 4:
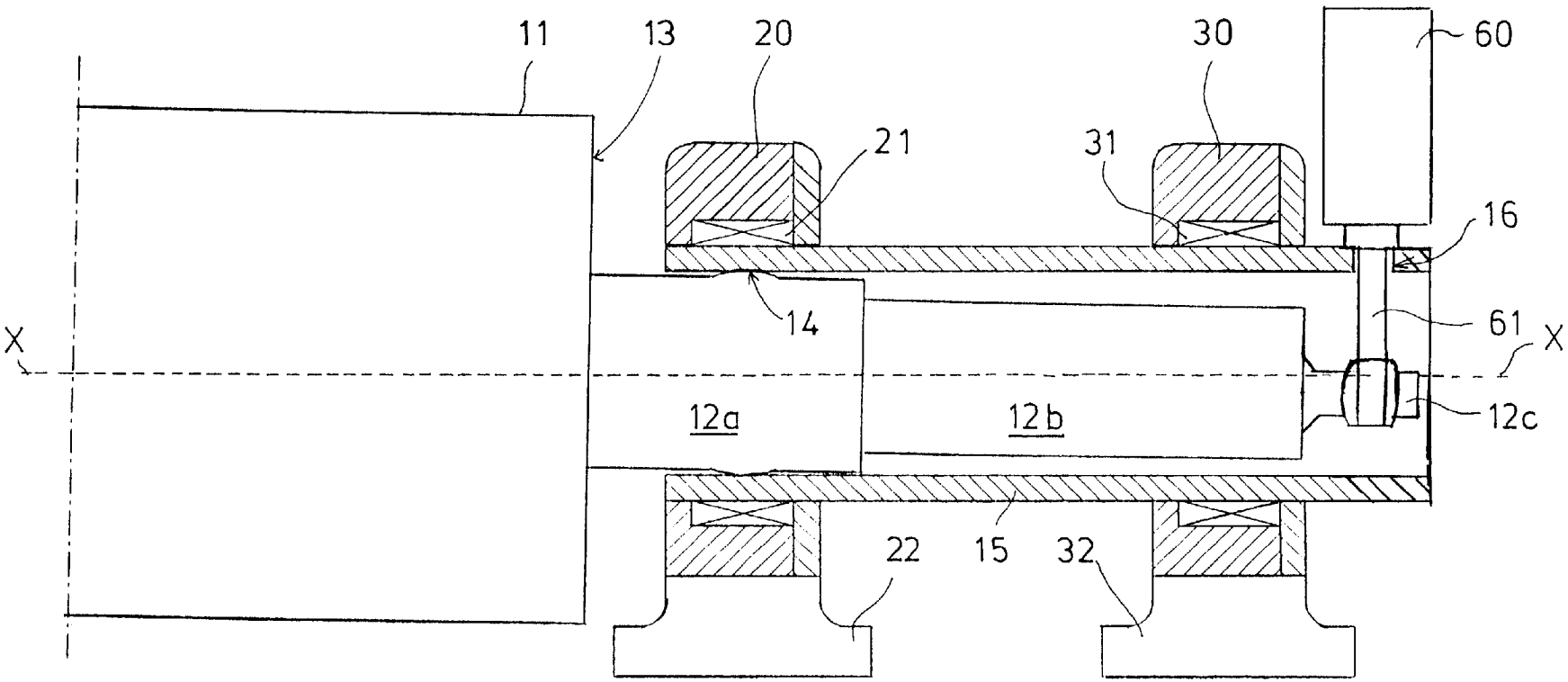
FIG. 4 shows a second modification of the embodiment as shown in FIG. 2.

FIG. 4 shows an embodiment which differs from the embodiments of FIGS. 2 and 3 in respect of the bending mechanism. As the bending mechanism 60, a hydraulic or pneumatic cylinder or a stepping motor is used. The rod 61 of the cylinder or of the stepping motor has been attached to an extension 12*c* made to the axle journal 12, and the cylinder or the motor has been attached to the support sleeve 15. Thus, vertical movement of the rod 61 extending through the bore 16 in the support sleeve 15 subjects the outer end 12*b* of the axle journal 12 to a torque, as a consequence of which the body 11 of the beam is bent.

Figure 5:
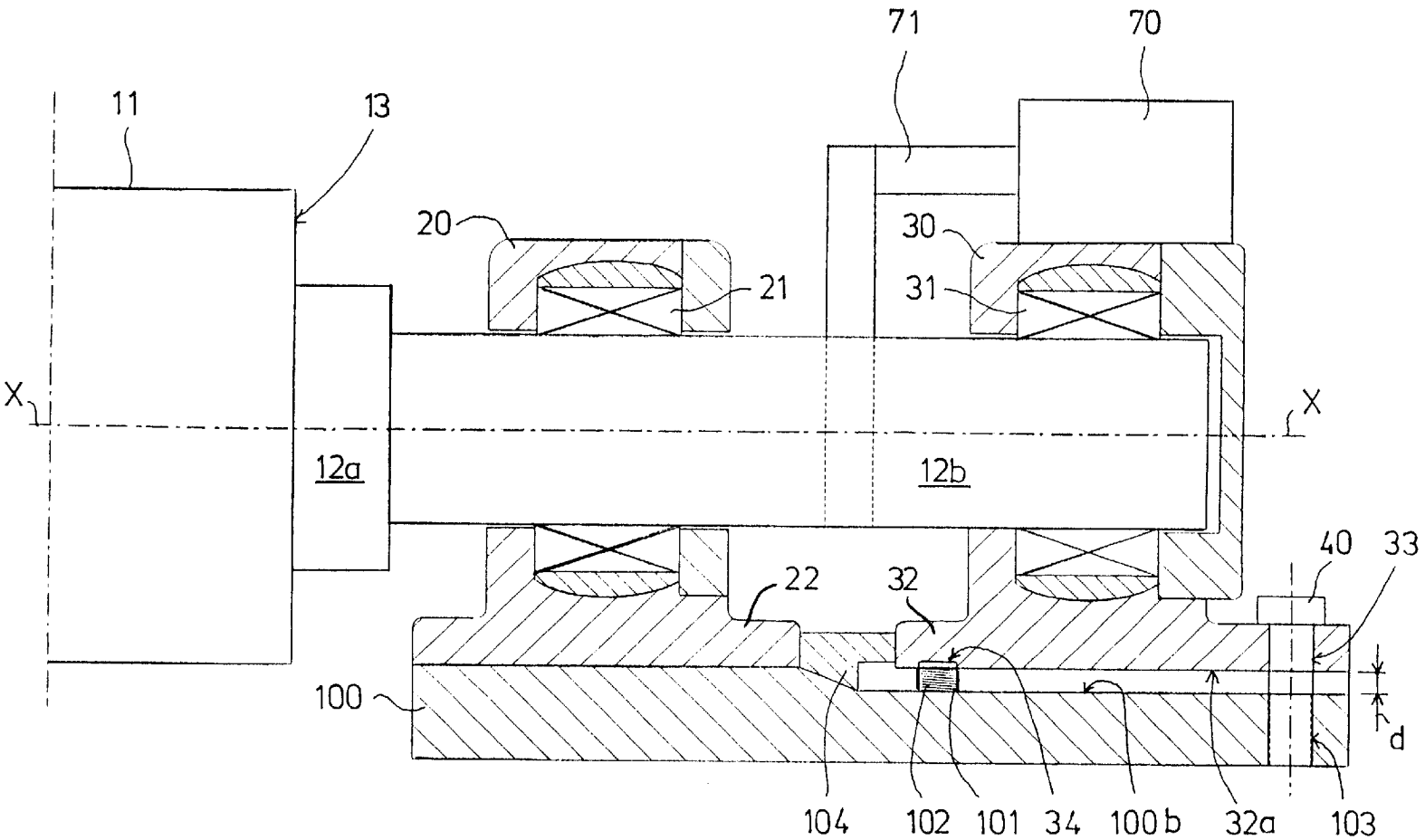
FIG. 5 shows an end area of a second embodiment of the beam in accordance with the invention.

FIG. 5 shows an embodiment which differs from the embodiments of FIGS. 2 . . . 4 in respect of the support construction. In this embodiment the support construction consists of bearing members 21, 31, of bearing housings 20,30, and of a base plate 100. Thus, here, no support sleeve 15 is employed between the axle journal 12 and the bearing members 21, 31. The outer circumference of the outer part 12*b* of the axle journal 12 is supported directly on bearing members 21, 31 placed at a distance from one another in the longitudinal direction of the axle journal 12. The bearing housing 20 of the first bearing member 21 has been attached from its bottom portion 22 rigidly to the base plate 100 of the support construction, which base plate 100 has again been fixed rigidly to the frame constructions of the machine. The bearing housing 30 of the second bearing member 31 has been supported from its bottom portion 32 to the base plate 100 by means of support members 101, 102 placed at a distance from one another in the longitudinal direction of the axle journal 12 and by means of a bending mechanism 40. The bending mechanism consists of a screw member 40, which extends through the bore 33 placed in the bottom portion 32 of the second bearing housing 30 into the bore 103 placed in the base plate 100, in which bore there is an inside threading that receives the outer threading on the screw 40. The support member consists of a pin 101 fixed to the base plate 101, which pin extends into a recess 34 provided in the bottom face 32*a* of the bottom portion 32 of the second bearing housing 30, and of a spring 102 surrounding the pin 101, which spring is placed in the space between the bottom face 32*a* of the bottom portion 32 of the second bearing housing 30 and the top face 100*b* of the base plate 100. The bottom face of the bottom portion 32 of the second bearing housing 30 and the top face 100*b* of the base plate 100 are placed at a distance d from one another. Between the bottom portion 22 of the first bearing housing 20 and the bottom portion 32 of the second bearing housing 30, there is a partition piece 104 fixed to the base plate 100, by means of which partition piece gliding of the bottom portion 32 of the second bearing housing 30 towards the bottom portion 22 of the first bearing housing 20 is prevented during bending of the body 11 of the beam.

By means of the screw 40, it is possible to adjust the distance d between the outer end of the bottom face 32*a* of the bottom portion 32 of the second bearing housing 30 and the outer end of the top face 100*b* of the base plate 100. When the second bearing housing 30 is displaced by means of the screw 40, the pin-screw combination 101, 102 permits a slight movement of rotation of the second bearing housing 30. Displacement of the second bearing housing 30 also displaces the outer end 12*b* of the axle journal 12, in which connection the body 11 of the beam is bent.

By means of the bearing members 21, 31, a slight longitudinal movement of the axle journal 12 in relation to the bearing housings 20,30 is permitted, which movement is necessary, for example, when the beam operates as a support beam for a doctor.

FIG. 5 also shows an actuator 70 mounted on the second bearing housing 30, by means of which actuator the axle journal 12 and, thereby, the beam can be oscillated in the longitudinal direction of the axle journal 12. The actuator 70 and the axle journal 12 have been interconnected by means of an arm construction 71, by whose intermediate the oscillating movement of the actuator 70 is transferred to the axle journal 12. The oscillating movement is produced, for example, by means of a pneumatic, hydraulic, electric motor or equivalent.

Figure 6:
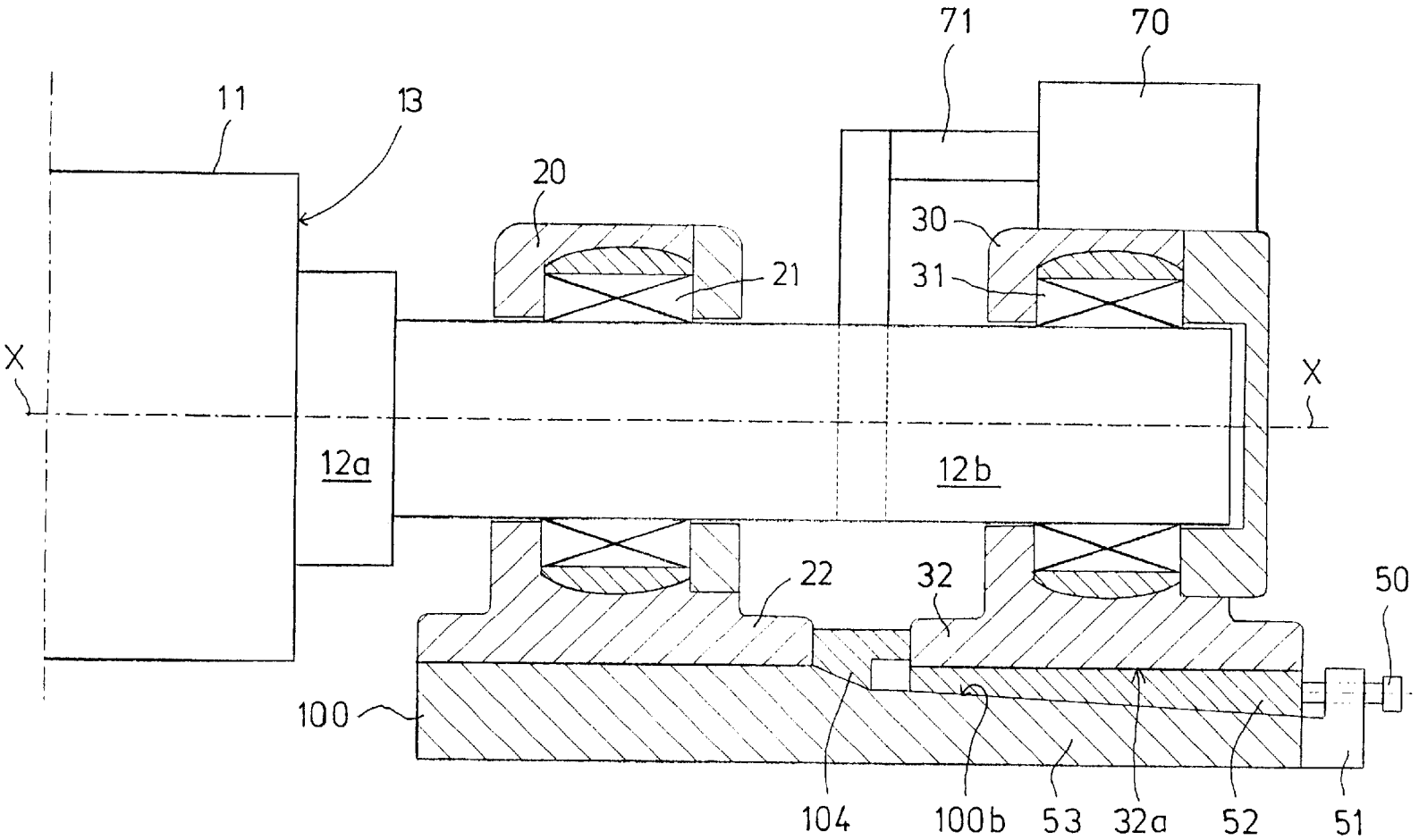
FIG. 6 shows a modification of the embodiment as shown in FIG. 5.

The embodiment shown in FIG. 6 differs from the embodiment of FIG. 5 in respect of the bending mechanism. Here the support member and the bending mechanism consist of a screw-wedge combination in a way similar to the embodiment shown in FIG. 3. By means of the screw member 50 provided with outside threading and fitted in a bore with inside threading in the fastening member 51 fixed to the outer end of the base plate 100, a first wedge member 52, which is placed between the bottom face 32*a* of the bottom portion 32 of the second bearing housing 30 and the top face 100*b* of the base plate 100, is pushed in the longitudinal direction of the axle journal 12. The wedge member 52 rests with its straight face against the bottom face 32*a* of the bottom portion 32 of the second bearing housing 30 and with its wedge face against the wedge face of a second wedge member 53. The second wedge member 53 consists of the outer end of the base plate 100, whose top face 100*b* has been formed as a wedge face. Pushing of the first wedge member 52 onto the second wedge member 53 displaces the second bearing housing 30 in relation to the longitudinal central axis X—X of said axle journal 12, in which connection a torque that bends the body 11 of the beam is applied to the axle journal 12.

Figure 7:
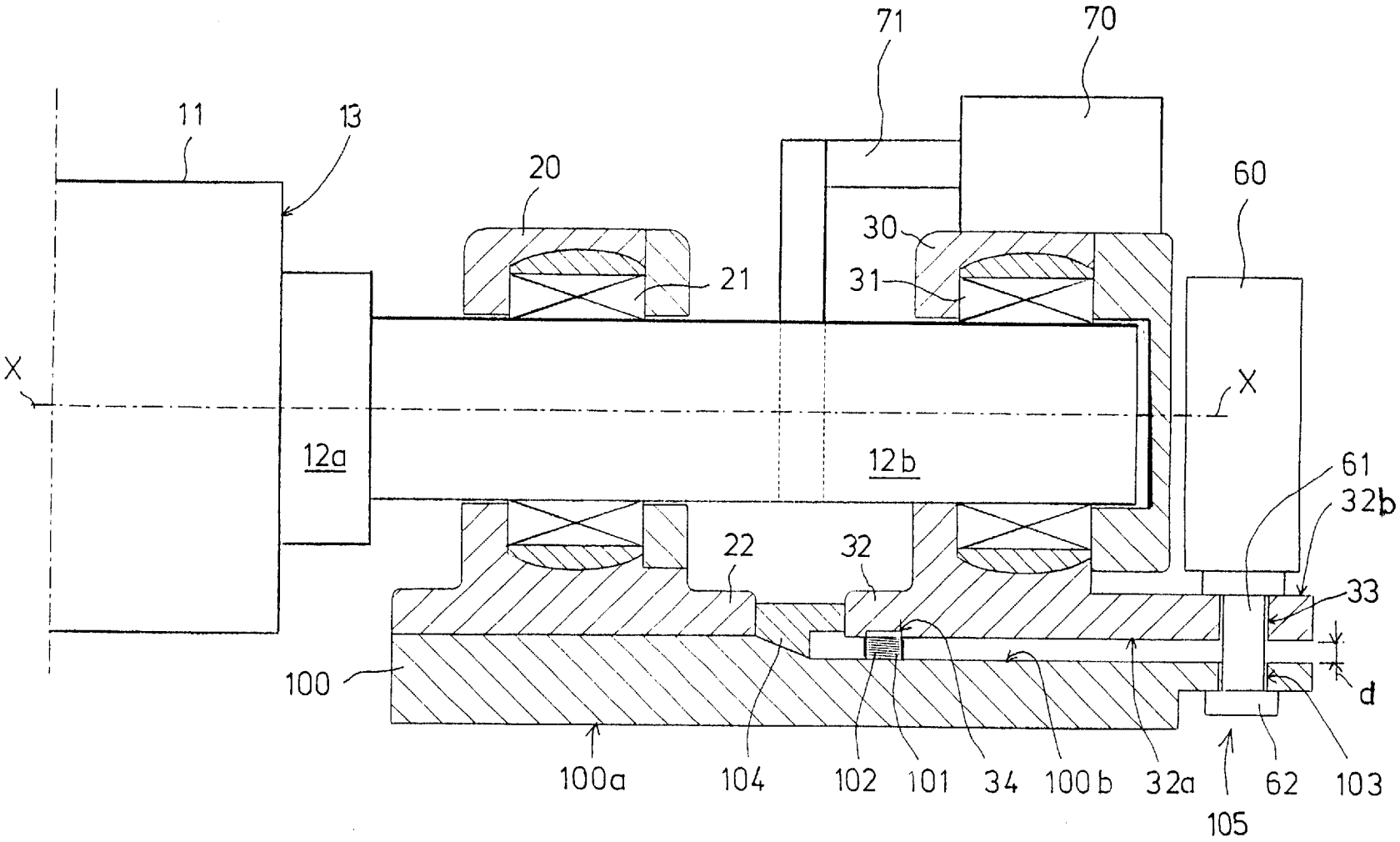
FIG. 7 shows a second modification of the embodiment as shown in FIG. 5.

The embodiment shown in FIG. 7 differs from the embodiments shown in FIGS. 5 and 6 in respect of the bending mechanism. Here, in stead of a screw member 40, as the bending mechanism a hydraulic or pneumatic cylinder or a stepping motor 60 is used in a way similar to that in the embodiment shown in FIG. 4. The rod 61 of the cylinder or of the stepping motor extends through a bore 33 provided in the outer end of the bottom portion 32 of the second bearing housing 30 and through a corresponding bore 103 provided in the outer end of the base plate 100 into a recess 105 provided in the bottom face 100*a* of the outer end of the base plate 100. The rod 61 has been attached to said recess 105 by means of a fastening member 62. The cylinder or motor 60 has been attached similarly to the top face 32*b* of the outer end of the bottom portion 32 of the second bearing housing 30. When the rod 61 is pulled into the interior of the cylinder or motor 60, the distance d between the outer end of the bottom portion 32 of the second bearing housing 30 and the outer end of the base plate 100 becomes shorter, in which connection a torque that bends the body 11 of the beam is applied to the axle journal 12.

Figure 8:
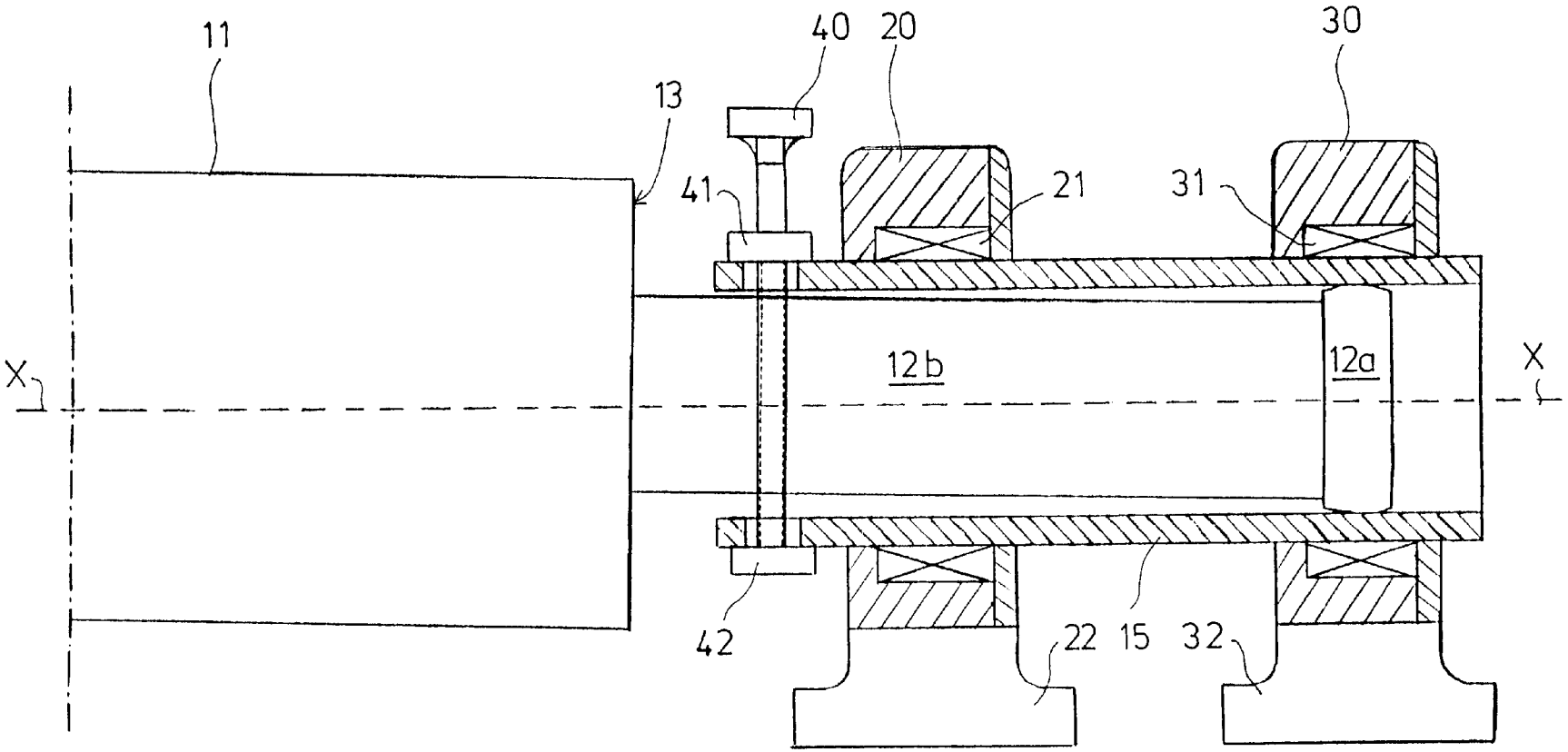
FIG. 8 shows a third modification of the embodiment as shown in FIG. 2.

FIG. 8 shows an embodiment which corresponds to the embodiment shown in FIG. 2 but in which the screw member 40 that displaces the axle journal 12 is placed between the first bearing housing 20 and the end piece 13 of the beam 11 and not after the second bearing housing 30, which is the case in the embodiment shown in FIG. 2. Here the parts 12*a* and 12*b* of the axle journal 12 change positions with each other, and the articulation point 14 is placed at the second bearing member 31.

The alternative shown in FIG. 8, in which the bending device 40 is placed between the end piece 13 of the beam and the nearest bearing housing 20, can, of course, also be applied to the embodiments of FIGS. 3 and 4. In the embodiments of FIGS. 5 to 7, it is, in a similar way, also possible to shift the bending mechanisms shown in the figures from the second bearing housing 30 to the first bearing housing 20.

In the embodiments shown in FIGS. 2 to 4 and 8, the bottom portions 22, 32 and/or the top portions of the bearing housings 20,30 can also consist of one piece.

The actuator 70 that produces longitudinal oscillation of the beam, illustrated in FIGS. 5 to 7 as fitted in connection with the second bearing housing 30, can, of course, equally well be placed in connection with the first bearing housing 20. Said actuator 70 is necessary in such applications only in which longitudinal oscillation of the beam is required, such as in applications connected with a doctor blade. The embodiments of FIGS. 5 to 7 can, of course, also be used without said actuator 70, such as, e.g., in sizer applicator beams, measurement beams, etc.

In the embodiments shown in FIGS. 2 to 8, the bearing housings 20,30 have been attached to the frame constructions of the machine. For example, if a beam that supports a doctor blade 2 is concerned, it must be possible to shift the beam between an operating position and a free position. In the operating position the doctor blade 2 is pressed against the face of the roll 1 to be cleaned, and in the free position the doctor blade 2 has been shifted completely out of connection with the face of the roll 1 to be cleaned. This can be arranged, for example, so that those frame constructions of the machine to which the bearing housings 20,30 or the base plate 100 have been attached are displaced by means of hydraulic cylinders (not shown in the figures).

In the embodiments shown in FIGS. 2, 3, 5, 6 and 8, the bending of the axle journal 12 takes place by means of forced displacement by means of a screw member 40, a wedge member 52, or equivalent. The screw member 40, the wedge member 52, or equivalent binds the axle journal 12 to the support point rigidly, in which case the beam is what is called rigidly supported in the sense of oscillation.

In the embodiments shown in FIGS. 4 and 7, the bending of the axle journal 12 takes place by means of hydraulics, pneumatics, or by means of a stepping motor 60, in which case the body of the beam is what is called freely supported or articulation-supported in the sense of oscillation. A hydraulic medium and a pneumatic medium usually yield to a slight extent, in which case the support is somewhat resilient.

With a rigid support, the lowest natural frequency of the beam is considerably higher as compared with a freely supported beam. When the natural frequency of the beam becomes higher, it is possible to use smaller material thicknesses in the beam, in which connection the forces transferred from the bending to the frame of the machine are reduced, and the cost of manufacture of the beam becomes lower.

In the following, the patent claims will be given, and the details of the invention can show variation within the scope of the inventive idea defined in said claims and differ from what has been stated above by way of example only.

What is claimed is:

1. A bendable beam assembly for use in a paper or board machine having a frame, the beam assembly comprising:

a continuous body made of a composite material;

end pieces fitted at each end of the body;

axle journals fitted on the end pieces, wherein each axle journal is supported on the frame of the machine by a support construction having at least a first bearing member and a second bearing member spaced from one another in a longitudinal direction of the axle journal, the bearing members being fitted in bearing housings; and a bending mechanism mounted to each support construction, by which bending mechanism a torque that bends the body of the beam is applied to the axle journals.

2. The beam assembly of claim 1 further comprising:

a support sleeve mounted to the first bearing member and the second bearing member supporting one axle journal; and an articulation member connected to an outer face of said one axle journal, the articulation member supporting said one axle journal on an inner face of the support sleeve.

3. The beam assembly of claim 2 wherein the articulation member of the one axle journal is located substantially at the first bearing member, and the bending mechanism is mounted substantially in the vicinity of the second bearing member.

4. The beam assembly of claim 2, wherein the articulation member of the one axle journal is placed substantially at the second bearing member, and the bending mechanism is mounted substantially in the vicinity of the first bearing member.

5. The beam assembly of claim 2, wherein the bending mechanism comprises:

portions of the one axle journal defining a bore which extends therethrough;

a screw member which passes through the support sleeve and through the one axle journal bore;

fastening members connected to the screw member which lock the screw member against movement in the direction of a screw member longitudinal axis, the fastening members being supported against an outer face of the support sleeve, and wherein the screw member has an outside threading substantially over a distance extending through the support sleeve; and wherein the screw member is received within inside threading within the bore in the one axle journal, whereat a torque that bends the body of the beam is applied to the axle journal by means of the screw member.

6. The beam assembly of claim 2 wherein the bending mechanism comprises:

a screw member having outside threading and moving in the longitudinal direction of the axle journal;

a fastening member attached to an inner face of the support sleeve and having an internally threaded bore extending in the longitudinal direction of the one axle journal, the screw member extending into the fastening member bore;

a first wedge member movable along the inner face of the support sleeve in the longitudinal direction of the one axle journal, the first wedge member being locked on the inner face of the support sleeve against radial movement, and the first wedge member having a wedge face which faces the one axle journal, and wherein an end of the screw member extends through the fastening member to engage against an end face of the first wedge member; and a second wedge member attached to the axle journal, the second wedge member having a wedge face which engages against the first wedge member wedge face, wherein pushing of the first wedge member onto the second wedge member by adjustment of the screw member applies a torque that bends the body of the beam to the one axle journal.

7. The beam assembly of claim 2, wherein the bending mechanism comprises an actuator attached to the support sleeve, and having an extendible rod attached to the one axle journal, wherein movement of the rod perpendicularly to the longitudinal direction of the one axle journal applies a torque that bends the body of the beam to the axle journal.

8. The beam assembly of claim 7 wherein the actuator is selected from the group consisting of a hydraulic cylinder, a pneumatic cylinder and a stepping motor.

9. The beam assembly of claim 1, wherein for each axle journal: the axle journal has an outer circumference from which the axle journal is directly supported on the bearing members, and the bearing housing of the first bearing member has a bottom portion which is rigidly attached to a base plate which is fixed to the machine frame, and the bearing housing of the second bearing member has a bottom portion which is attached to the base plate by a support member and by a bending mechanism, and wherein a partition piece is attached to the base plate between the bearing housing of the first bearing member and the bearing housing of the second bearing member, wherein the partition piece prevents shifting of the bottom portion of the second bearing housing towards the bottom portion of the first bearing housing in connection with bending of the body of the beam.

10. The beam assembly of claim 9, wherein the support member comprises:

a pin attached to the base plate, the pin being fitted in a recess opening upwardly from a bottom face of the bottom portion of the second bearing housing, and a spring surrounding the pin and positioned in a space between a top face of the base plate and the bottom face of the bottom portion of the second bearing housing, and wherein the bending mechanism comprises:

a screw member which extends through a bore placed in an outer end of the bottom portion of the second bearing housing into a threaded bore that is placed in an outer end of the base plate which receives the screw member, wherein adjustment of the screw changes the distance between the bottom face of the outer end of the bottom portion of the second bearing housing and the top face of the outer end of the base plate to displace the second bearing housing and apply a torque that bends the axle journal and the body of the beam.

11. The beam assembly of claim 9, wherein the support member and the bending mechanism comprise:

a wedge member having a straight face and a wedge face, the wedge member being positioned between the top face of the base plate and the bottom face of the bottom portion of the second bearing housing; and a screw member acting upon said wedge member, wherein the wedge member is supported by its straight face against the bottom face of the bottom portion of the second bearing housing and by means of its wedge face against a wedge-shaped top face of the outer end of the base plate, and wherein the screw member is supported in a bore with inside threading in a fastening member fixed to the outer end of the base plate, the end of the screw member being positioned against an outer end of the wedge member, as a result of which the wedge member is shiftable in the longitudinal direction of the axle journal, the second bearing housing being displaced as a consequence, in which connection a torque that bends the body of the beam is applied to the axle journal.

12. The beam assembly of claim 10, wherein the bending mechanism comprises an actuator having an extendible rod which is attached to the outer end of the bottom portion of the second bearing housing, the actuator rod extending through bores in the outer end of the bottom portion of the second bearing housing and in the outer end of the base plate into a recess formed into the bottom face of the base plate, in which recess the rod is attached to the bottom face of the base plate by a fastening member, in which connection a movement of the rod perpendicularly to the longitudinal direction of the axle journal displaces the second bearing housing, in which connection a torque that bends the body of the beam is applied to the axle journal.

13. The beam assembly of claim 12 wherein the actuator is selected from the group consisting of a hydraulic cylinder, a pneumatic cylinder and a stepping motor.

14. The beam assembly of claim 1 further comprising an element mounted to the continuous body, said element being selected from the group consisting of a doctor blade, a measurement device, an induction device, and a coating device.

15. The beam assembly of claim 1 wherein the continuous body is not cylindrical.

16. A bendable beam assembly for use in a papermaking machine having a frame, the beam assembly comprising:

a continuous body made of a composite material;

end pieces fitted at each end of the body;

axle journals fitted on the end pieces, wherein each axle journal is supported on the frame of the machine by a support construction having at least a first bearing member and a second bearing member spaced from one another in a longitudinal direction of the axle journal, the bearing members being fitted in bearing housings; and means for applying a torque to the axle journals to bend the body of the beam.

17. A bendable beam assembly for use in a papermaking machine having a frame, the beam assembly comprising:

a continuous non-cylindrical body made of a composite material and having a first end and a second end;

a first end piece fitted to the first end of the body, and a second end piece fitted to the second end of the body;

a first axle journal connected to the first end piece, and a second axle journal connected to the second end piece;

a first support construction having at least a first bearing member and a second bearing member spaced from one another in a longitudinal direction of the first axle journal, the bearing members being connected to bearing housings, the first axle journal being supported by the two first support construction bearing members;

a second support construction having at least a first bearing member and a second bearing member spaced from one another in a longitudinal direction of the second axle journal, the bearing members connected to bearing housings, the second axle journal being supported by the two second support construction; and a first bending mechanism mounted to the first support construction, and a second bending mechanism mounted to the second support construction, each bending mechanism applying a torque to one of the axle journals to bend the body of the beam.

18. The beam assembly of claim 17 wherein each of the first support construction and the second support construction further comprises:

a support sleeve mounted to the first bearing member and the second bearing member, the support sleeve supporting one of the first and second axle journals; and an articulation member connected to an outer face of said one axle journal, the articulation member supporting said one axle journal on an inner face of the support sleeve.

19. The beam assembly of claim 18 wherein the articulation members of the axle journals are located substantially at the first bearing members, and each bending mechanism is mounted substantially in the vicinity of one of the second bearing members.

20. The beam assembly of claim 18, wherein the articulation members of the one axle journals are placed substantially at the second bearing members, and each bending mechanism is mounted substantially in the vicinity of one of the first bearing members.

21. The beam assembly of claim 18, wherein each of the first bending mechanism and the second bending mechanism comprises:

portions of one axle journal defining a bore which extends therethrough;

a screw member which passes through the support sleeve and through the one axle journal bore;

fastening members connected to the screw member which lock the screw member against movement in the direction of a screw member longitudinal axis, the fastening members being supported against an outer face of the support sleeve, and wherein the screw member has an outside threading substantially over a distance extending through the support sleeve; and wherein the screw member is received within inside threading within the bore in the one axle journal, whereat a torque that bends the body of the beam is applied to the axle journal by means of the screw member.

22. The beam assembly of claim 18 wherein each of the first bending mechanism and the second bending mechanism comprises:

a screw member having outside threading and moving in the longitudinal direction of one axle journal;

a fastening member attached to an inner face of the support sleeve and having an internally threaded bore extending in the longitudinal direction of the one axle journal, the screw member extending into the fastening member bore;

a first wedge member movable along the inner face of the support sleeve in the longitudinal direction of the one axle journal, the first wedge member being locked on the inner face of the support sleeve against radial movement, and the first wedge member having a wedge face which faces the one axle journal, and wherein an end of the screw member extends through the fastening member to engage against an end face of the first wedge member; and a second wedge member attached to the axle journal, the second wedge member having a wedge face which engages against the first wedge member wedge face, wherein pushing of the first wedge member onto the second wedge member by adjustment of the screw member applies a torque that bends the body of the beam to the one axle journal.

23. The beam assembly of claim 18, wherein each of the first bending mechanism and the second bending mechanism comprises an actuator attached to the support sleeve, and having an extendible rod attached to one axle journal, wherein movement of the rod perpendicularly to the longitudinal direction of the one axle journal applies a torque that bends the body of the beam to the axle journal.

24. The beam assembly of claim 17, wherein for each axle journal: the axle journal has an outer circumference from which the axle journal is directly supported on the bearing members, and the bearing housing of the first bearing member has a bottom portion which is rigidly attached to a base plate which is fixed to the machine frame, and the bearing housing of the second bearing member has a bottom portion which is attached to the base plate by a support member and by a bending mechanism, and wherein a partition piece is attached to the base plate between the bearing housing of the first bearing member and the bearing housing of the second bearing member, wherein the partition piece prevents shifting of the bottom portion of the second bearing housing towards the bottom portion of the first bearing housing in connection with bending of the body of the beam.

25. The beam assembly of claim 24, wherein the support member comprises:

a pin attached to the base plate, the pin being fitted in a recess opening upwardly from a bottom face of the bottom portion of the second bearing housing; and a spring surrounding the pin and positioned in a space between a top face of the base plate and the bottom face of the bottom portion of the second bearing housing, and wherein the bending mechanism comprises:

a screw member which extends through a bore placed in an outer end of the bottom portion of the second bearing housing into a threaded bore that is placed in an outer end of the base plate which receives the screw member, wherein adjustment of the screw changes the distance between the bottom face of the outer end of the bottom portion of the second bearing housing and the top face of the outer end of the base plate to displace the second bearing housing and apply a torque that bends the axle journal and the body of the beam.

26. The beam assembly of claim 24, wherein the support member and the bending mechanism comprise:

a wedge member having a straight face and a wedge face, the wedge member being positioned between the top face of the base plate and the bottom face of the bottom portion of the second bearing housing; and a screw member acting upon said wedge member, wherein the wedge member is supported by its straight face against the bottom face of the bottom portion of the second bearing housing and by means of its wedge face against a wedge-shaped top face of the outer end of the base plate, and wherein the screw member is supported in a bore with inside threading in a fastening member fixed to the outer end of the base plate, the end of the screw member being positioned against an outer end of the wedge member, as a result of which the wedge member is shiftable in the longitudinal direction of the axle journal, the second bearing housing being displaced as a consequence, in which connection a torque that bends the body of the beam is applied to the axle journal.

27. The beam assembly of claim 25, wherein the bending mechanism comprises an actuator having an extendible rod which is attached to the outer end of the bottom portion of the second bearing housing, the actuator rod extending through bores in the outer end of the bottom portion of the second bearing housing and in the outer end of the base plate into a recess formed into the bottom face of the base plate, in which recess the rod is attached to the bottom face of the base plate by a fastening member, in which connection a movement of the rod perpendicularly to the longitudinal direction of the axle journal displaces the second bearing housing, in which connection a torque that bends the body of the beam is applied to the axle journal.

28. The beam assembly of claim 17 further comprising an element mounted to the continuous body, said element being selected from the group consisting of a doctor blade, a measurement device, an induction device, and a coating device.

* * * * *